US005226676A

United States Patent [19]

Su

[11] Patent Number: 5,226,676

[45] Date of Patent: Jul. 13, 1993

[54] FILE FOLDER

[76] Inventor: Ken J. Su, No. 102, Lane 52, Fu Te Rd., Ta Li Hsiang, Taichung Hsien, Taiwan

[21] Appl. No.: 900,009

[22] Filed: Jun. 18, 1992

[51] Int. Cl.[5] ..... B42D 3/10; B42D 3/18

[52] U.S. Cl. ..... 281/45; 281/28; 412/34; 229/15 R

[58] Field of Search ..... 40/359; 281/4, 19.1, 281/20, 29, 28, 45, 46; 412/34; 229/1.5 R

[56] References Cited

U.S. PATENT DOCUMENTS 4,867,479 9/1989 Mizutani ..... 412/34 X 4,904,104 2/1990 Gloeckle ..... 281/45 X 5,086,970 2/1992 Su ..... 229/84

*Primary Examiner*—Allan N. Shoap

*Assistant Examiner*—Jes F. Pascua

*Attorney, Agent, or Firm*—Welsh & Katz, Ltd.

[57] ABSTRACT

A file folder including a base having two stripes formed on one edge and folded such that the outer stripe contacts the base, an opening formed in the middle portion of a middle stripe, a clip including a panel engageable on a lower portion of the base and another panel insertable into the opening of the middle stripe for clamping the outer stripe and the base together in order to hold sheets of paper between the outer stripe and the base.

18 Claims, 4 Drawing Sheets

FILE FOLDER

BACKGROUND OF THE INVENTION

1. Field of the Invention

The present invention relates to a file folder and more particularly to a file folder for carrying paper and records.

2. Description of the Prior Art

The closest prior art of which applicant is aware is his prior U.S. Pat. No. 5,086,970 to Su. The envelope is provided to stably and safely retain paper therein.

Another type of file folder which has been commercially available for a long time is shown in FIG. 5 and comprises a longitudinally clip 51 having a split 52 longitudinally formed therein for clamping papers 55 which are protected by two sheets of covers 53, the covers 53 are made of transparent plastic materials. In the file folder, it is very difficult to insert the edge portions of the covers 53 and the papers 55 into the split 52 such that the users may feel inconvenienced.

The present invention has arisen to mitigate and/or obviate the afore-described disadvantages of the conventional file folders.

SUMMARY OF THE INVENTION

The primary objective of the present invention is to provide a file folder in which papers can be easily retained in place by the file folder.

In accordance with one aspect of the invention, there is provided a file folder including a base having a first stripe and a second stripe formed integral thereon with the second stripe formed between the body and the first stripe, the first stripe being folded relative to the second stripe and the second stripe being folded relative to the body of the base and arranged such that the first stripe contacts an upper portion of the body of the base, an opening formed in a middle portion of the second stripe, a clip including a first panel engageable on a lower portion of the body and a second panel insertable into the opening of the second stripe and engaged on the first stripe for clamping the first stripe and the body together in order to hold sheets of paper between the first stripe and the body.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
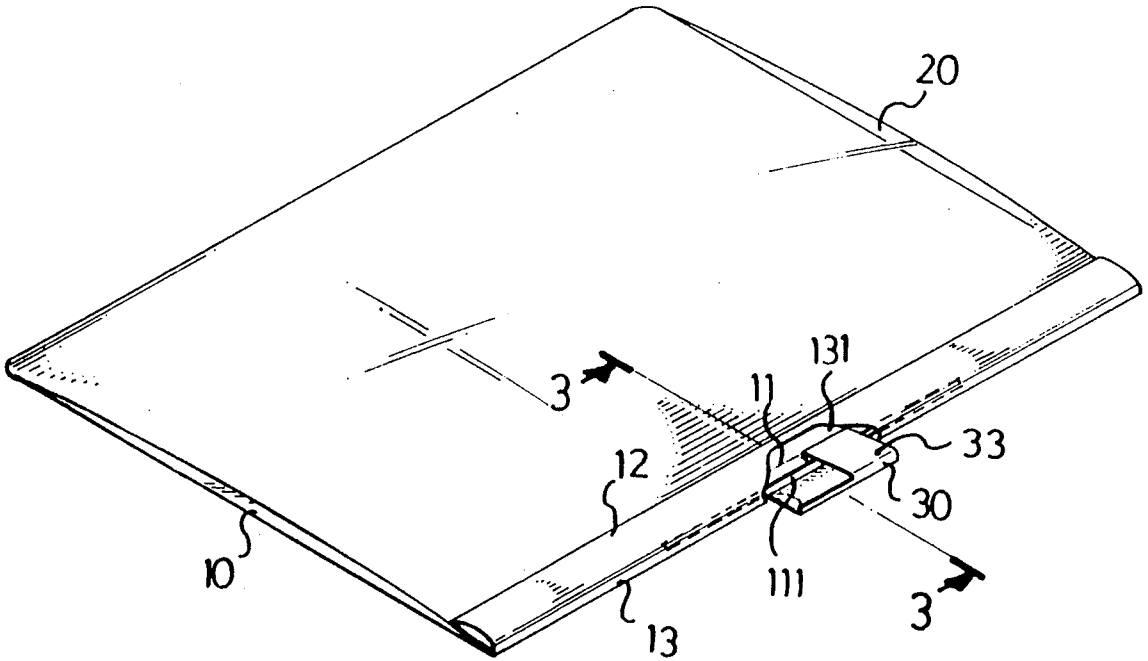
FIG. 1 is a perspective view of a file folder in accordance with the present invention, in which for clear illustration purposes, part of the folder is cut off.
Figure 2:
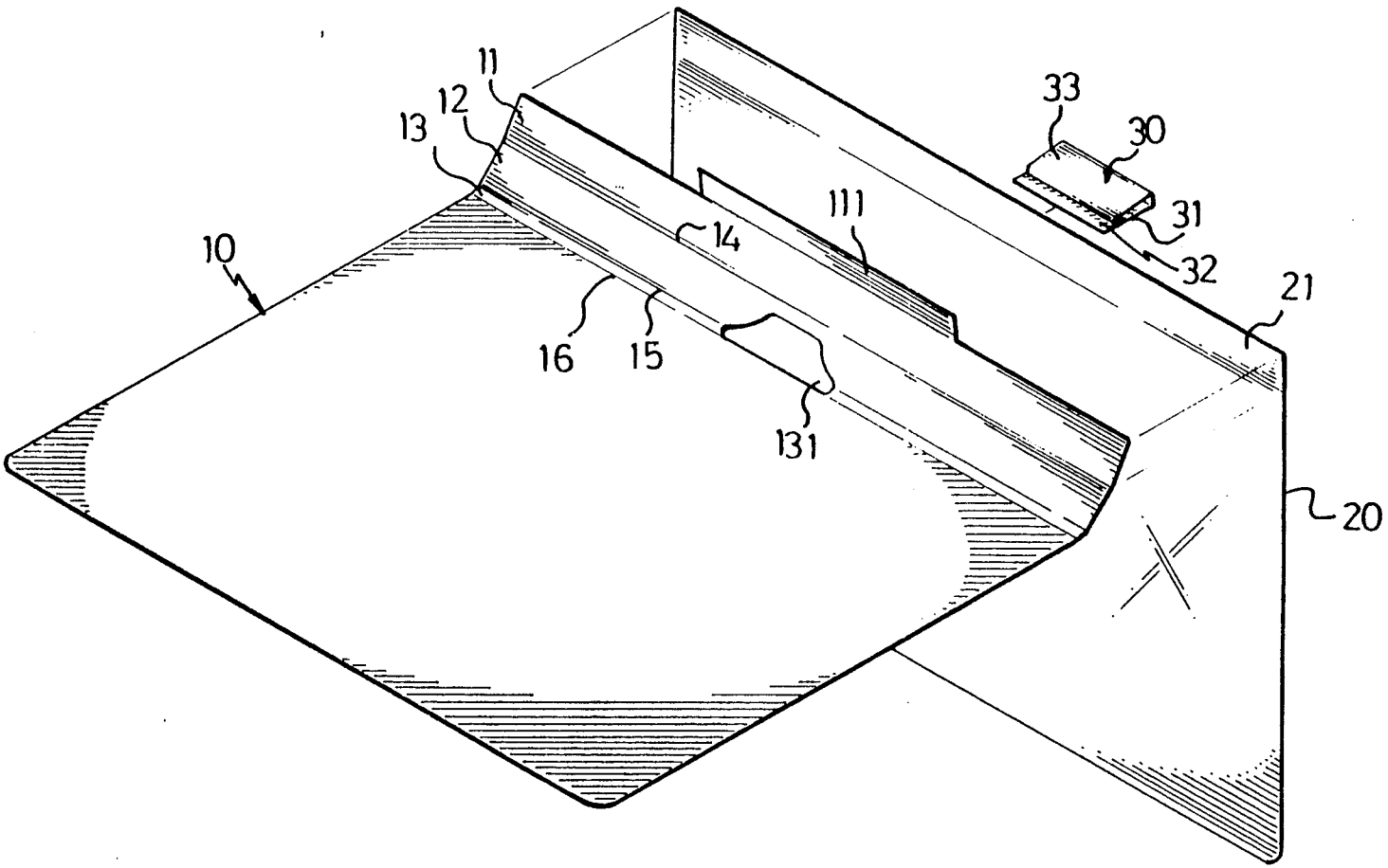
FIG. 2 is an exploded view of the file folder.
Figure 3:
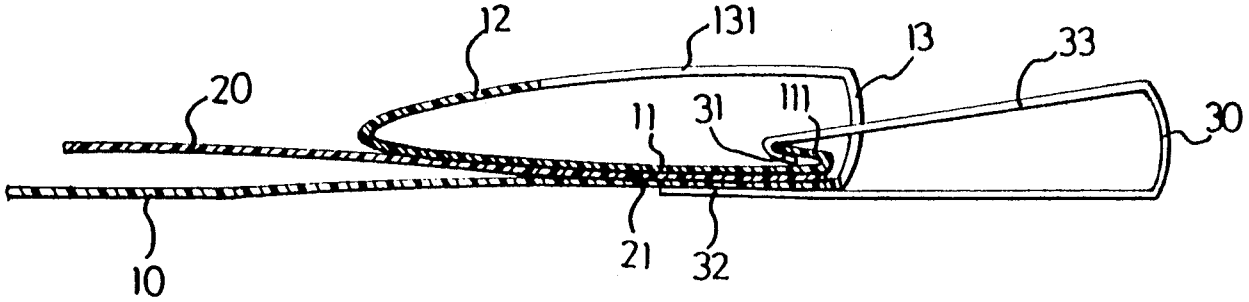
FIG. 3 is an enlarged cross sectional view of the file folder taken along lines 3—3 of FIG. 1.

Referring to the drawings, and initially to FIGS. 1 to 3, a file folder in accordance with the present invention comprises generally a base 10 including three stripes 11, 12, 13 formed in parallel in one of four side edges thereof and with a folding line 14, 15 formed between every two adjacent stripes 11, 12, 13, and a folding line 16 is formed between the stripe 13 and the body of the base 10, a flap 111 formed integral on the free edge of the first stripe 11 and folded relative to the stripe 11, and an opening 131 formed in the middle portion of the second stripe 12 and the third stripe 13; and a cover 20 including a fourth stripe 21 formed integral on one of four side edges thereof, the fourth stripe 21 and the first stripe 11 of the base 10 are preferably formed integral by heat or ultrasonic welding operations. The stripes 11, 12, 13 are folded such that the cover 20 is disposed above the base 10. The base 10 and the cover 20 are preferably made of transparent plastic materials.

A clip 30 includes a first panel 32 and a second panel 33 for clamping sheet materials therebetween, in which the second panel 33 includes a hook portion 31 formed in the free edge thereof, and, as best shown in FIG. 3, slightly tapered downwards and backwards. The second panel 33 is inserted into the opening 131; and the first panel 32 is engaged on the lower portion of the base 10.

As shown in FIGS. 1 and 3, the clip 30 can be pulled outwards of the opening 131, the hook 31 of the clip 30 is engageable with the flap 111 of the base 10, and the outward movement of the clip 30 relative to the opening 131 is limited by the engagement of the hook 31 with the flap 111 such that the clip 30 is prevented from disengagement from the base 10 and the cover 20.

Figure 4:
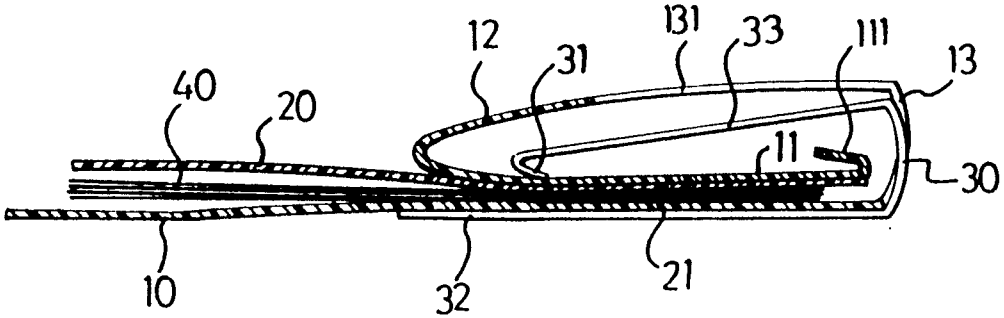
FIG. 4 is an enlarged cross sectional view similar to FIG. 3 illustrating the operations of the file folder.
Figure 5:
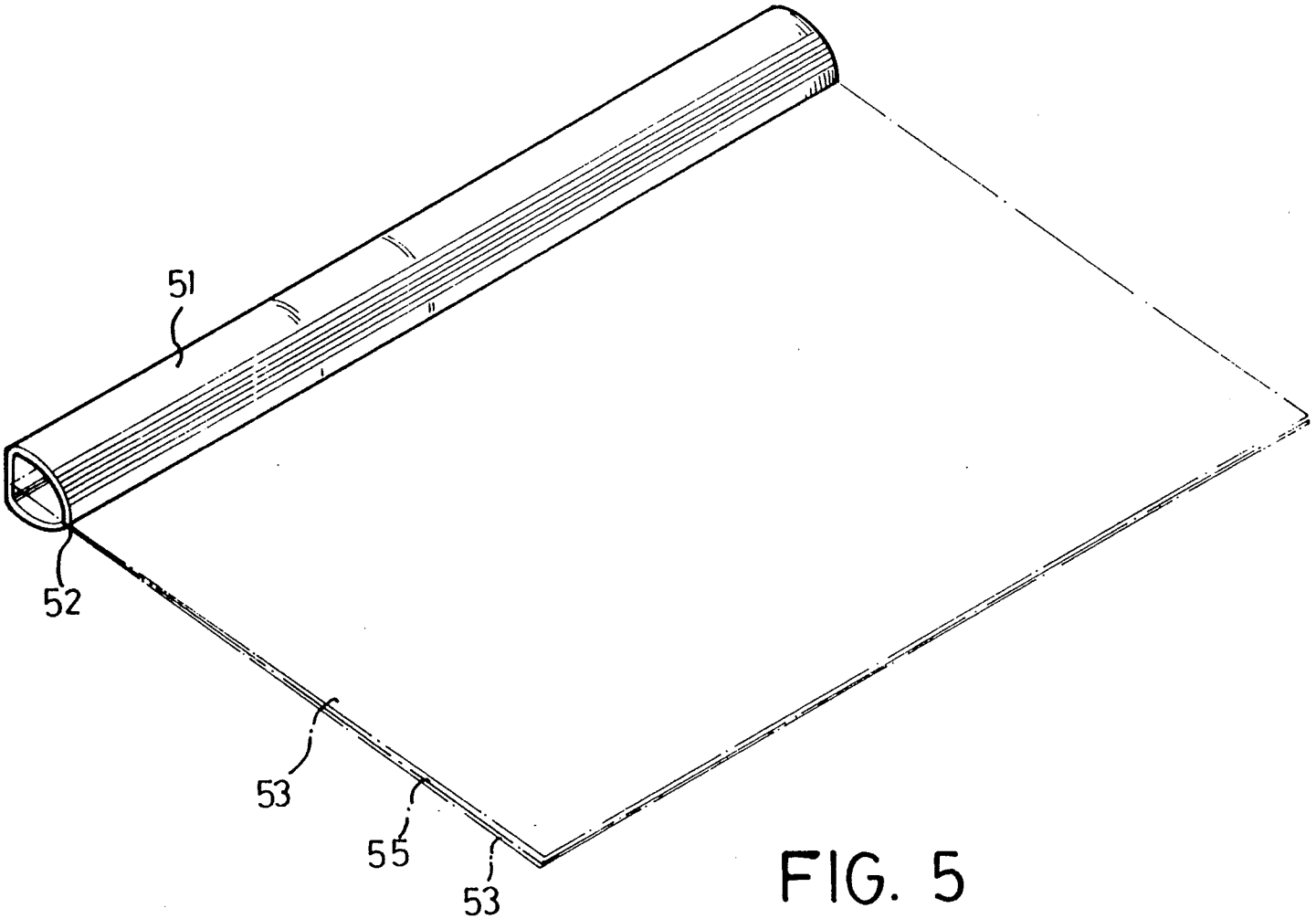
FIG. 5 PRIOR ART
FIG. 5 is a perspective view illustrating the typical file folder.

In operation, referring to FIGS. 3 and 4, and initially to FIG. 3, when the clip 30 is pulled outward of the opening 131, the first stripe 11 of the base 10 and the fourth stripe 21 of the cover 20 are not clamped by the clip 30, such that letters, paper or documents 40 to be held between the base 10 and the cover 20 can be easily inserted into the position between the first stripe 11 of the base 10 and the fourth stripe 21 of the cover 20. After the documents 40 are inserted into place, the clip 30 is pushed into the opening 131 and is pushed to the position as shown in FIG. 4, such that the documents 40 which are held between the cover 20 and the base 10 can be clamped by the clip 30.

Alternatively, without the cover 20, the edge portion of the document 40 can also be engaged and protected between the first stripe 11 and the body of the base 10, the document 40 can also be easily inserted into the position between the first stripe 11 and the body of the base 10 when the clip 30 is pulled outward of the opening 131.

Further alternatively, without the third stripe 13 and the folding line 16, the second stripe 12 can also be formed integral with the body of the base 10 and is directed folded from the body of the base 10. The provision of the third stripe 13 permits the engagement of a plurality sheets of paper or a stack of paper between the base 10 and the cover 20, the third stripe 13 with larger width allows more sheets of paper to be held in place.

Further alternatively, instead of formation on the free edge of the first stripe 11, the flap 111 can also be a punch portion punched from the first stripe 11, i.e., a punch portion extends from the first stripe 11 for engagement with the hook 31 of the clip 30 in order to limit the outward movement of the clip 30 relative to the base 10 and the cover 20.

Accordingly, papers, letters and documents can be easily and stably retained in place by the file folder in accordance with the present invention.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A file folder comprising a base including a body having a first stripe and a second stripe formed integral thereon with said second stripe formed between said body and said first stripe, said first stripe being folded relative to said second stripe and said second stripe being folded relative to said body of said base and arranged such that said first stripe contacts an upper portion of said body of said base, an opening formed in a middle portion of said second stripe, a clip including a first panel engageable on a lower portion of said body and a second panel insertable into said opening of said second stripe and engaged on said first stripe for clamping said first stripe and said body together in order to hold sheets of paper between said first stripe and said body.

2. A file folder according to claim 1, wherein a flap is formed on a middle portion of said first stripe and extended upward toward said second stripe and located in said opening of said second stripe, said second panel of said clip includes a hook portion formed thereon for engagement with said flap of said first stripe in order to limit an outward movement of said clip relative to said opening of said second stripe.

3. A file folder according to claim 2, wherein said flap is formed integral on a free edge of said first stripe opposite to said second stripe, said flap is folded relative to said first stripe for engagement with said hook portion of said clip.

4. A file folder according to claim 1, wherein a third stripe is formed between said second stripe and said body of said base, said second stripe is folded relative to said third stripe and said third stripe is folded relative to said body of said base, said third stripe allows more sheets of paper to be held between said first stripe and said body of said base.

5. A file folder according to claim 4, wherein said opening is formed in said middle portion of said second stripe and in a middle portion of said third stripe.

6. A file folder according to claim 1 further comprising a cover including a third stripe formed thereon, said third stripe of said cover being engaged between said first stripe and said body of said base such that said sheets of paper are held between said cover and said base.

7. A file folder according to claim 6, wherein said third stripe of said cover is fixed to said first stripe of said base.

8. A file folder comprising a base including a body having a first stripe and a second stripe formed integral thereon with said second stripe formed between said body and said first stripe, said first stripe being folded relative to said second stripe and said second stripe being folded relative to said body of said base and arranged such that said first stripe contacts an upper portion of said body of said base, an opening formed in a middle portion of said second stripe, a flap formed on a middle portion of said first stripe and extended upward toward said second stripe and located in said opening of said second stripe, a clip including a first panel engageable on a lower portion of said body and a second panel insertable into said opening of said second stripe and engaged on said first stripe for clamping said first stripe and said body together, said second panel of said clip including a hook portion formed thereon for engagement with said flap of said first stripe in order to limit an outward movement of said clip relative to said opening of said second stripe, said clip being provided to clamp a plurality of sheets of paper between said first stripe and said body.

9. A file folder according to claim 8, wherein said flap is formed integral on a free edge of said first stripe opposite to said second stripe, said flap is folded relative to said first stripe for engagement with said hook portion of said clip.

10. A file folder according to claim 8, wherein a third stripe is formed between said second stripe and said body of said base, said second stripe is folded relative to said third stripe and said third stripe is folded relative to said body of said base, said third stripe allows more sheets of paper to be held between said first stripe and said body of said base.

11. A file folder according to claim 10, wherein said opening is formed in said middle portion of said second stripe and in a middle portion of said third stripe.

12. A file folder according to claim 8 further comprising a cover including a third stripe formed thereon, said third stripe of said cover being engaged between said first stripe and said body of said base such that said sheets of paper are held between said cover and said base.

13. A file folder according to claim 12, wherein said third stripe of said cover is fixed to said first stripe of said base.

14. A file folder comprising a base including a body having a first stripe and a second stripe formed integral thereon with said second stripe formed between said body and said first stripe, said first stripe being folded relative to said second stripe and said second stripe being folded relative to said body of said base and arranged such that said first stripe contacts an upper portion of said body of said base, an opening formed in a middle portion of said second stripe, a flap formed on a middle portion of a free edge of said first stripe opposite to said second stripe and extended upward toward said second stripe and located in said opening of said second stripe, said flap being folded relative to said first stripe, a clip including a first panel engageable on a lower portion of said body and a second panel insertable into said opening of said second stripe and engaged on said first stripe for clamping said first stripe and said body together, said second panel of said clip including a hook portion formed thereon for engagement with said flap of said first stripe in order to limit an outward movement of said clip relative to said opening of said second stripe, said clip being provided to clamp a plurality of sheets of paper between said first stripe and said body.

15. A file folder according to claim 14, wherein a third stripe is formed between said second stripe and said body of said base, said second stripe is folded relative to said third stripe and said third stripe is folded relative to said body of said base, said third stripe allows more sheets of paper to be held between said first stripe and said body of said base.

16. A file folder according to claim 15, wherein said opening is formed in said middle portion of said second stripe and in a middle portion of said third stripe.

17. A file folder according to claim 14 further comprising a cover including a third stripe formed thereon, said third stripe of said cover being engaged between said first stripe and said body of said base such that said sheets of paper are held between said cover and said base.

18. A file folder according to claim 17, wherein said third stripe of said cover is fixed to said first stripe of said base.

* * * * *